US006398876B1

(12) United States Patent
Starcevic et al.

(10) Patent No.: US 6,398,876 B1
(45) Date of Patent: Jun. 4, 2002

(54) PROCESS FOR PICKLING STEEL

(75) Inventors: Jovan Starcevic, Vienna; Dietfried Gamsriegler, Neustadt, both of (AT)

(73) Assignee: Andritz—Patentverwaltungs-Gesellschaft m.b.H., Graz (AT)

( * ) Notice: Subject to any disclaimer, the term of this patent is extended or adjusted under 35 U.S.C. 154(b) by 0 days.

(21) Appl. No.: 09/467,376

(22) Filed: Dec. 21, 1999

(30) Foreign Application Priority Data

Dec. 22, 1998 (AT) ..... 2129/98

(51) Int. Cl.[7] ..... C23G 1/02

(52) U.S. Cl. ..... 134/3; 134/2; 134/22.13; 134/22.16; 134/22.17; 134/23; 134/26; 134/27; 134/28; 134/29; 134/32; 134/36; 134/41; 134/42

(58) Field of Search ..... 205/640, 673, 205/674; 510/258; 134/2, 3, 22.16, 22.13, 23, 22.17, 32, 36, 41, 42, 26, 27, 28, 29

(56) References Cited

U.S. PATENT DOCUMENTS

| | | | | | |
|---|---|---|---|---|---|
| 3,043,758 | A | * | 7/1962 | Machu | 204/145 |
| 3,607,482 | A | * | 9/1971 | Selm | 156/19 |
| 3,787,306 | A | * | 1/1974 | Senoir et al. | 204/105 R |
| 3,870,585 | A | * | 3/1975 | Kearns et al. | 159/4 A |
| 3,969,207 | A | * | 7/1976 | Kerti et al. | 204/180 P |
| 4,149,946 | A | * | 4/1979 | Burke | 204/180 P |
| 4,197,139 | A | * | 4/1980 | Hjersted | 134/12 |
| 4,391,685 | A | * | 7/1983 | Shepard et al. | 204/145 R |
| 4,415,415 | A | * | 11/1983 | Zaremski | 204/141.5 |
| 4,851,092 | A | * | 7/1989 | Maresch | 204/145 R |
| 5,022,971 | A | * | 6/1991 | Maresch et al. | 204/145 R |
| 5,076,884 | A | * | 12/1991 | Aguilar et al. | 156/642 |
| 5,702,534 | A | * | 12/1997 | Rodabaugh et al. | 134/7 |
| 5,800,694 | A | * | 9/1998 | Starcevic et al. | 205/705 |
| 5,851,304 | A | * | 12/1998 | Giraud et al. | 134/3 |

FOREIGN PATENT DOCUMENTS

| | | | |
|---|---|---|---|
| DE | 003801018 A1 | * | 7/1998 |
| FR | 2732041 A1 | * | 9/1996 |
| JP | 63216986 A | * | 9/1988 |
| JP | 401062485 A | * | 3/1989 |
| JP | 05039600 | * | 2/1993 |
| JP | 09013200 | * | 1/1997 |

* cited by examiner

*Primary Examiner*—Sharidan Carrillo
(74) *Attorney, Agent, or Firm*—Roylance, Abrams, Berdo & Goodman, L.L.P.

(57) ABSTRACT

Stainless steel is pickled by a chemical and/or electrochemical pickling process using an acid liquid, containing substantially no nitric acid. The process uses a spent electrolyte solution from an electrochemical, neutral salt pickling tank, such as a sodium sulfate pickling tank. The spent electrolyte solution is added to an acid solution to form a pickling acid capable of pickling stainless steel, oxidizing $Fe^{2+}$ to $Fe^{3+}$ and reducing $Cr^{6+}$ to $Cr^{3+}$.

18 Claims, 1 Drawing Sheet

PROCESS FOR PICKLING STEEL

FIELD OF THE INVENTION

The present invention is directed to a process for the chemical and/or electrochemical pickling of stainless steel in an acid solution substantially in the absence of nitric acid. More specifically, the invention is directed to a process for pickling stainless steel using the spent electrolyte solution from an electrolytic pickling tank.

BACKGROUND OF THE INVENTION

The surface layer of oxide on a steel strip is generally objectionable when the steel is to be further processed. Hot rolled steel typically has a layer of scale on the surface which must be removed prior to drawing, stamping or other deforming process. The scale produced by hot working of steel is formed of iron oxides and other metal oxides. The scale formed on stainless steel typically contains chromium oxides and manganese oxides in addition to the iron oxides. Pickling is the process of chemically removing metal oxides and scale from the surface of the metal by exposing the oxide layer to inorganic acids. The rate and extent of pickling depends on several variables including, for example, the temperature and acid concentration of the pickling bath. Numerous acid pickling processes and pickling tanks are known in the industry.

Stainless steel sheets or strips are often produced by a hot rolling process followed by an annealing process which produces a layer of scale on the steel strip. The layer of scale is often removed by a pickling process using an acid mixture of hydrofluoric and nitric acid. The concentration and ratio of the acids can vary, depending on the plant and type of steel being pickled. Acid pickling of stainless steel produces good results, but produces considerable environmental concerns. The pickling processes that use nitric acid generate nitrous vapors ($NO_x$). The nitrous vapors must be contained and removed from the system to comply with environmental regulations. The nitrates also are carried through the wash water and in the spent acid baths, thereby increasing the expense for proper disposal.

As a result of the draw backs of nitric acid pickling solutions, several processes have been proposed to pickle stainless steel without nitric acid. These processes generally replace the nitric acid with a different mineral acid such as sulfuric acid or hydrochloric acid. The redox potential is adjusted by the content of the iron oxides in solution. In the pickling process, iron in the form of bivalent ions dissolves in solution, and the trivalent iron ion is produced either by partial oxidation of $Fe^{2+}$ or by adding $Fe^{3+}$ salts. Various processes are known where the trivalent iron ions are produced by the oxidation of $Fe^{2+}$ with hydrogen peroxide. Other processes add $Fe^{3+}$ salts to the pickling bath in the form of sulfates, chlorides, nitrates or fluorides.

One example of a process for descaling stainless steel is disclosed in U.S. Pat. No. 5,879,465. The disclosed method treats the stainless steel with hydrochloric acid followed by a mechanical abrasion.

The hot-rolled stainless steel strip after pickling is often rolled to a thinner thickness and subsequently annealed a second time. This process produces a thin layer of scale which must be removed gently without damaging the surface quality or shine of the steel. Electrochemical pickling processes have attained general world-wide acceptance for pickling cold rolled stainless steel strips. The electrochemical pickling process can include a sodium sulfate solution. This process produces a spent pickling solution containing large amounts of chromate ions ($Cr^{6+}$). Since the chromate ions are highly toxic, the spent pickling solution must be treated to remove the chromate ions before the solution can be discarded. Spent pickling solution is generally detoxified by reducing the $Cr^{6+}$ to $Cr^{3+}$ in a separate treatment process. The detoxifying step must be performed before the spent solution can be neutralized and the pickling solution regenerated. Chromate detoxification is very costly and requires the addition of various reducing agents such as $Na_2S_2O_5$ or similar sulfur compounds. The process for reducing $Cr^{6+}$ to $Cr^{3+}$ is as follows:

$$4H_2CrO_4+3Na_2S_2O_5+3H_2SO_4 \rightarrow 2Cr_2(SO_4)_3+3Na_2SO_4+7H_2O$$

An alternative reduction process is as follows:

$$2H_2CrO_4+6FeSO_4+6H_2SO_4 \rightarrow 2Cr_2(SO_4)_3+3Fe_2(SO_4)_3+8H_2O$$

Various electrolytic pickling processes are known in the art. These processes apply a voltage between the electrolyte and the steel being treated using a reference electrode. One example of a prior process for electrolytically pickling a stainless steel sheet uses an alternating current in a mixed acid bath as disclosed in U.S. Pat. No. 5,786,556. Another process for electrolytically pickling a stainless steel strip is disclosed in U.S. Pat. No. 5,804,056. This process passes the stainless steel through an acid bath containing a plurality of anodes and cathodes arranged in an alternating fashion. The electrolytic pickling of stainless steel results in toxic chromium in the electrolyte. One prior process disclosed in U.S. Pat. No. 4,851,092 adds an acid and reducing agent to produce a solution free of $CrO_4^{2-}$.

The above-noted processes for treating stainless steel to remove the scale are generally effective in removing the oxide layer. However, due to the environmental concerns, these processes have required additional detoxification steps and the expense for the detoxification. Accordingly, there is a continuing need in the industry for improved processes for pickling stainless steel.

SUMMARY OF THE INVENTION

The present invention is directed to a process for the chemical and/or electrochemical pickling of stainless steel. More particularly, the invention is directed to a process for pickling stainless steel in an acid bath substantially in the absence of nitric acid.

Accordingly, a primary object of the invention is to provide a pickling process for stainless steel which overcomes the disadvantages of the prior processes by eliminating the need to contain and remove nitrous vapors from the pickling tank.

A further object of the invention is to provide a pickling process for stainless steel which eliminates the requirement for detoxification of the chromate ions in the spent pickling solution.

A further object of the invention is to provide an acid pickling process for stainless steel where a spent sulfate electrolyte pickling solution is added to the pickling acid in an amount to reduce $Cr^{6+}$ to $Cr^{3+}$.

Another object of the invention is to provide an acid pickling solution that contains spent electrolyte solution from an electrochemical pickling tank.

Another object of the invention is to provide a chemical or electrochemical process for pickling stainless steel and particularly a cold-rolled stainless steel using an acid pickling solution containing spent sodium sulfate electrolyte solution from an electrochemical pickling bath.

Still another object of the invention is to provide a process for pickling stainless steel where the $Fe^{2+}$ can be oxidized to $Fe^{3+}$ without the addition of conventional oxidizing agents.

A further object of the invention is to add an acid to a spent electrolyte neutral salt solution to simultaneously oxidize $Fe^{2+}$ to $Fe^{3+}$ and reduce $Cr^{6+}$ to $Cr^{3+}$.

Another object of the invention is to provide a process for pickling stainless steel in an acid pickling solution where the redox potential of the acid is adjusted by controlling the amount of a spent electrolyte solution from an electrochemical pickling bath.

A further object of the invention is to provide a process for pickling stainless steel using an acid pickling solution where bivalent and trivalent iron salts are added to the pickling acid.

Another object of the invention is to provide a process for pickling stainless steel by providing a neutral salt electrochemical pickling bath and an acid pickling bath in series where the spent electrochemical pickling solution is supplied to the acid pickling bath.

A further object of the invention is to provide a process for pickling stainless steel using a neutral salt electrolytic bath and an acid bath in series where the spent pickling acid is neutralized to remove iron oxides and the neutralized solution fed to the electrolytic bath.

The objects of the invention as basically attained by providing a process of pickling stainless steel comprising the steps of: combining a spent pickling solution obtained from a neutral salt electrochemical pickling process with an acid solution and forming an acid pickling solution, the acid pickling solution being substantially free of nitric acid, and contacting a stainless steel metal substrate with the acid pickling solution for sufficient time to pickle the stainless steel substrate.

The objects of the invention are further attained by providing a process of pickling stainless steel comprising the steps of: feeding a spent sulfate electrolyte solution obtained from a neutral salt electrolytic pickling bath to a pickling tank, adding an acid solution and iron sulfate to the spent electrolyte solution to produce an acid pickling solution which has substantially no nitric acid and has a redox potential for pickling stainless steel, and feeding a stainless steel substrate through the pickling tank and contacting the stainless steel substrate with the acid pickling solution for sufficient time to pickle the stainless steel substrate, wherein $Fe^{2+}$ produced during the pickling step is oxidized to $Fe^{3+}$ and $Cr^{6+}$ in the pickling solution is reduced to $Cr^{3+}$.

The objects, advantages and other salient features of the invention will become apparent from the following detailed description which, taken in conjunction with the annexed drawings, disclose preferred embodiments of the invention.

BRIEF DESCRIPTION OF THE DRAWINGS

Referring to the drawings which form a part of this original disclosure, in which.

DETAILED DESCRIPTION OF THE INVENTION

Figure 1:
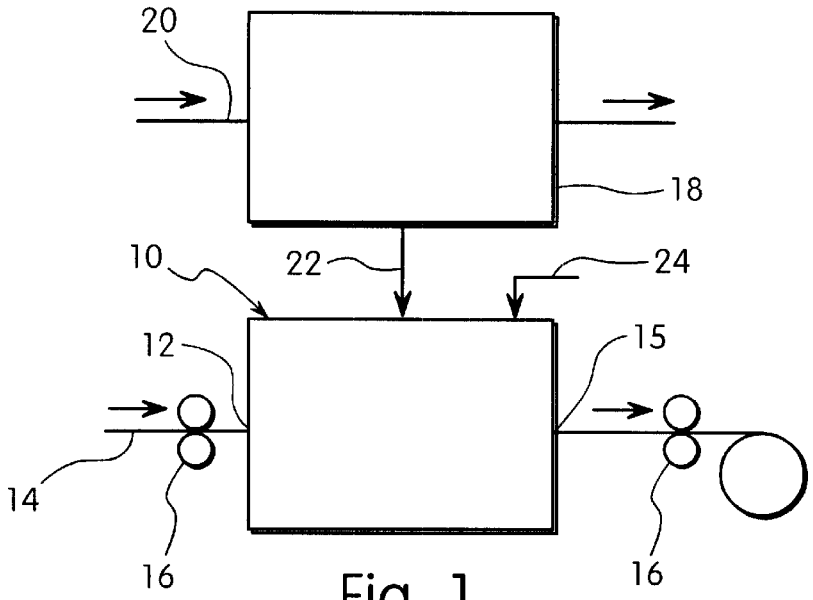
FIG. 1 is a schematic drawing of the pickling process in a first embodiment of the invention.

The present invention is directed to a process for pickling stainless steel using an acidified spent pickling solution from an electrolytic pickling tank. The process is carried out by chemical or electrochemical treatment of the stainless steel substantially in the absence of nitric acid.

The process of the invention can be carried out using conventional pickling tanks as known in the art. Examples of suitable equipment and pickling tanks for use in conjunction with the invention are disclosed in U.S. Pat. No. 4,851,092 to Maresch, U.S. Pat. No. 4,201,650 to Nagano, and U.S. Pat. No. 4,391,685, which are hereby incorporated by reference in their entirety.

The process of the invention is able to effectively pickle a stainless steel substrate in a continuous or batch process while eliminating the disadvantages of nitric acid pickling and detoxification of the chromate. The pickling solution of the invention includes a spent neutral salt pickling solution from an electrolytic pickling process. Neutral salt pickling processes as known in the art use a salt solution such as a sodium sulfate solution having a sodium sulfate concentration of about 10 g/l to about 250 g/l. The pH of the solution can range from about pH 1.5 to pH 7, and typically less than about 3.0 by the addition of sulfuric acid. The electrolytic pickling tank typically contains a bath of the neutral salt solution and includes a series of alternating anodes and cathodes. The anodes and cathodes are connected to a suitable DC power source for applying an electric current to the electrodes. Alternatively, an alternating current can be applied as known in the art. The concentration of the neutral salt, pH, $Fe^{3+}$ concentration, redox potential and current density are adjusted as known in the art to provide the desired rate of pickling.

The process of the invention is directed to a process of pickling stainless steel using a spent electrolyte solution from an electrolytic or electrochemical process. In preferred embodiments, the neutral salt electrolytic solution is from a sodium sulfate electrolytic pickling solution. The process of the invention avoids the use of nitric acid and provides a convenient process for oxidizing $Fe^{2+}$ to $Fe^{3+}$ in the pickling solution.

Initially, the pickling solution of the invention is prepared by introducing an amount of spent neutral salt pickling solution into a pickling tank. Then an acid or mixture of acids and iron sulfate ($FeSO_4$) are added to the spent pickling solution to adjust the redox potential to a desired value, and thereby produce the pickling solution of the present invention. In one embodiment, for example, the redox potential can be adjusted to about 50 to about 100 mV.

The amount of acid and iron sulfate added to the spent neutral pickling solution is selected to attain the desired oxidation-reduction (redox) potential, $Fe^{3+}$ and $Fe^{2+}$ concentration and pH according to conventional values as known in the art.

The acid is generally a mineral acid as known in the art that is substantially free of nitric acid. In one embodiment of the invention, the acid is selected from the group consisting of sulfuric acid, hydrofluoric acid, hydrochloric acid, and mixtures thereof. In embodiments of the invention, the acid can be a spent pickling acid substantially free of nitric acid. The spent pickling acid can be obtained from an acid pickling tank for pickling a hot rolled stainless steel strip.

The process of the invention generally does not require the addition of oxidizing agents. However, in some embodiments of the invention, an oxidizing agent, such as hydrogen peroxide, can be added to the pickling solution as needed. Various inhibitors as known in the art can also be added to the pickling solution to control corrosion attack on the material being pickled and the equipment.

Referring to FIG. 1, the process of the invention uses a conventional pickling tank 10 having an inlet end 12 for receiving a sheet or strip of stainless steel 14 and an outlet end 15. Several guide rollers 16 can be provided to feed the stainless steel strip through the pickling tank 10. An electrolytic pickling tank 18 contains a neutral salt electrolyte solution that is preferably a sodium sulfate solution. A stainless steel strip 20 is fed through the pickling tank 18 to pickle the strip.

In the embodiment illustrated, spent neutral salt pickling solution is supplied through a line 22 from the electrolytic pickling tank 18 to the pickling tank 10. In one embodiment, pickling tank 18 is a cold-rolled stainless steel pickling tank. A supply of fresh or regenerated acid and iron sulfate are supplied through a feed pipe 24 to the pickling tank 10 to adjust the pH and redox potential to a desired level. In one embodiment of the invention, the redox potential an range from about 300 mV to about 600 mV and generally in the range of about 400 mV to about 500 mV. The pickling tank 10 can be a standard chemical pickling tank or an electrolytic pickling tank having suitable electrodes and a power source as known in the art.

The redox potential of the acid pickling solution can be measured intermittently or continuously during the pickling process. The supply of spent neutral salt electrolyte can be fed to the pickling tank at a rate to maintain the redox potential within a desired range. The feed of the spent neutral salt electrolyte can be continuous or intermittent.

The resulting acid pickling solution is able to effectively pickle stainless steel with satisfactory results. The pickling solution obtains the desired concentration of the trivalent iron ion ($Fe^{3+}$) from the spent electrolyte solution and generally does not require the addition of oxidizing agents normally added to oxidize the divalent iron to trivalent iron. Thus, in one embodiment of the invention, the process is carried out substantially in the absence of added oxidizing agents. The spent electrolyte solution contains the trivalent iron in the form of suspended iron hydroxide ($Fe(OH)_3$) sludge and hexavalent chromium ($Cr^{6+}$). The hexavalent chromium reacts with bivalent iron ($Fe^{2+}$) produced during the pickling process to oxidize the $Fe^{2+}$ to $Fe^{3+}$ and to reduce the $Cr^{6+}$ to $Cr^{3+}$. The resulting solution in preferred embodiments contains substantially no $Cr^{6+}$.

Figure 2:
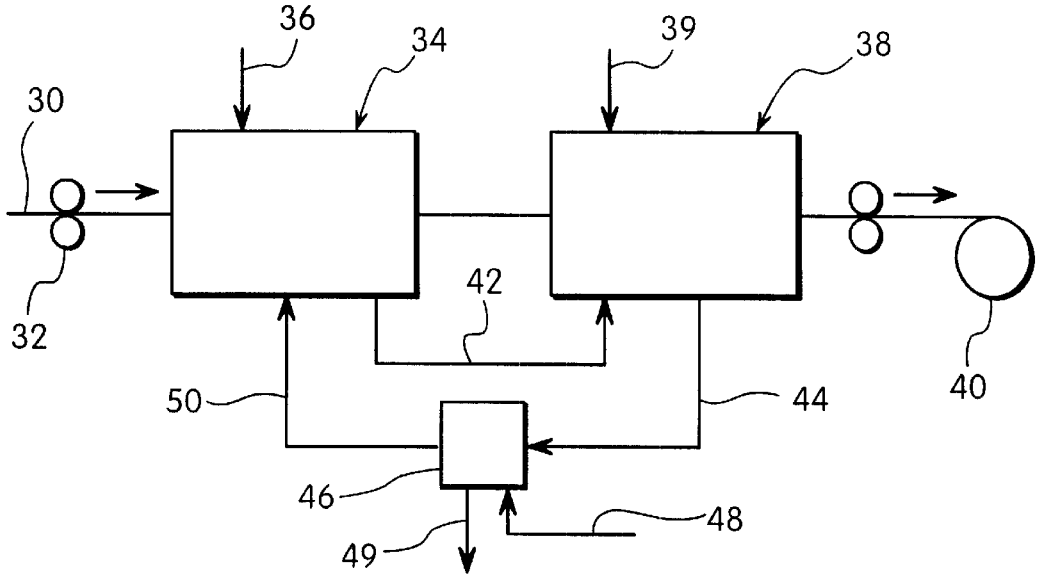
FIG. 2 is a schematic diagram of the pickling process in a second embodiment of the invention.

Referring to FIG. 2, a second embodiment of the invention is illustrated showing a continuous process for pickling stainless steel. A stainless steel strip 30 is fed through feed rollers 32 to an electrolytic pickling tank 34. A source of fresh or regenerated neutral salt electrolyte is supplied through a feed pipe 36 into the pickling tank 34. The stainless steel strip 30 exits the electrolytic pickling tank 34 and is fed to a second pickling tank 38. A source of fresh acid and iron sulfate are supplied to the second pickling tank 38 through a line 39. The second pickling tank 38 can be a conventional acid pickling tank or an electrolytic pickling tank having suitable electrodes and a power source. The pickled stainless steel strip exits the second pickling tank 38 to a suitable storage roll 40 or further processing step.

The spent electrolyte solution obtained from pickling tank 34 is preferably a sulfate electrolyte. The spent electrolyte solution is supplied to the second pickling tank 38 in an amount to reduce $Cr^{6+}$ produced during the pickling process to $Cr^{3+}$. The rate of addition of the spent electrolyte to the acid pickling solution preferably maintains the redox potential at a desired value. The redox potential of the acid pickling solution can be measured continuously or intermittently and the feed rate of the spent electrolyte solution adjusted to maintain a desired redox potential.

Spent neutral salt electrolyte solution from the electrolytic pickling tank 34 is supplied continuously through a feed pipe 42 to the second pickling tank 38 at a rate to maintain a desired redox potential in the second pickling tank 38. Spent pickling acid from the second tank 38 is withdrawn through a pipe 44 and directed to a regenerating tank 46. The pickling liquid in the regenerating tank 46 is mixed with a neutralizing agent that is added through a feed pipe 48. The neutralizing agent is preferably an alkaline agent such as caustic soda ($Na_2CO_3$). The neutralizing agent allows the metal hydroxides to be separated from the pickling solution and to regenerate the sodium sulfate electrolyte solution. The metal hydroxides removed from the pickling liquid include $Fe(OH)_2$, $Fe(OH)_3$, $Cr(OH)_3$and $Ni(OH)_2$. The hydroxides can be removed using standard processes including microfiltration through a line 49.

The regenerated pickling liquid from tank 46 is supplied through a pipe 50 and recycled to the electrolytic pickling tank 34. In preferred embodiments, the regenerated sodium sulfate pickling liquid is continuously supplied to the electrolytic pickling tank 34. In the embodiment illustrated, the pickling bath using the spent neutral electrolyte is positioned downstream of the electrolytic pickling tank. In further embodiments, the pickling tank using the spent neutral salt electrolyte can be positioned upstream of the electrolytic pickling tank. In still further embodiments, the second pickling tank that receives the spent electrolyte solution can be an electrolytic pickling tank.

The various advantages of the invention are set forth in the following non-limiting Examples.

EXAMPLE 1

A first solution was obtained at the end of a long test series on electrolytic pickling of cold-rolled stainless steel strip. The spent electrolyte solution had a metal content typically occurring in large scale pickling plants. The $Cr^{6+}$ concentration was 4.8 g/l. The iron ($Fe^{3+}$) and nickel ($Ni^{2+}$) were present in the form of suspended hydroxide sludge and the chromium in the form of chromate ($Cr^{6+}$) and where chemically dissolved.

Next, a second solution was prepared comprising a mixture of sulfuric acid, hydrofluoric acid and $FeSO_4$. The solution had the following components as determined by chemical analysis:

free $H_2SO_4$=400 g/l free HF=50 g/l $Fe^{2+}$=40 g/l

Mixtures of these two solutions were then prepared so that the redox potential of the resulting new mixture was between 400 and 500 mV. The subsequent pickling tests with scaled, hot-rolled stainless steel strip resulted in a slightly longer pickling time than a conventional mixed acid, however, the results were still satisfactory. Abrasive-blasted AISI 304 metal test sheets were pickled to a bright finish in approximately 70 seconds. After several test pickles, the pickling liquid was subjected to a chemical analysis and no traces of hexavalent chromium ($Cr^{6+}$) were found. The bivalent iron ($Fe^{2+}$) present had reduced $Cr^{6+}$ to trivalent chromium ($Cr^{3+}$). None of the pickling tests in the series performed showed the sodium ions to have any influence on the pickling result. These tests also confirmed that it is an advantage to add inhibitors to suppress corrosion attack by the sulfuric acid on the base material.

The advantages of this "nitrate-free pickling process" in which no nitrous gases form is that the trivalent iron ion ($Fe^{3+}$) is produced by the spent electrolyte solution resulting in a cost advantage. Unlike the processes used to date, there is no need to add hydrogen peroxide ($H_2O_2$) as an oxidation agent to produce $Fe^{3+}$, nor is any reducing agent ($Na_2S_2O_5$) needed for chromate detoxification. The spent electrolyte solution contains the trivalent iron in the form of suspended hydroxide sludge ($Fe(OH)_3$) and the hexavalent chromium ($Cr^{6+}$). The $Cr^{6+}$ is found to react directly with the bivalent iron ($Fe^{2+}$) produced by the pickling process, thereby generating $Fe^{3+}$ and $Cr^{3+}$.

In the course of the pickling tests, it was observed that the pickling effect dropped as the redox potential fell. It is therefore desirable to continuously add the spent electrolyte solution to the pickling bath at a rate based on the measured redox potential. The redox potential can be continuously measured and the amount of the spent electrolyte fed to the pickling controlled to maintain a desired redox potential.

EXAMPLE 2

A further test was carried out with a cold-rolled stainless steel strip. A bivalent iron salt ($FeSO_4$) and 96% sulfuric acid were added to a spent sodium sulfate electrolyte solution, thereby raising the concentration of free sulfuric acid to 100 g/l and the redox potential to 440 mV. The liquid thus obtained was used as electrolyte for electrochemical pickling bath. In these pickling tests, it was observed that compared with electrolytic pickling in pure sulfuric acid, there was less corrosion attack on the base material and the original brightness of the sheet metal samples was retained after pickling. In comparison with electrolytic treatment in the neutral range, however, where the quality (brightness) rises as the treatment progresses, a significantly higher pickling loss was obtained. With an AISI 304 stainless steel sample, for example, and treatment (=charge density) of 600 $A^*sec/dm^2$, a pickling loss of approximately 1.2 $g/m^2$ was measured in the neutral electrolyte and approximately 2.0 $g/m^2$ with the freshly prepared acid electrolyte solution.

EXAMPLE 3

An electrolytic treatment with a charge density of 200 $A^*sec/dm^2$ was carried out in an acidified spent electrolyte solution, where the redox potential had been set to 440 mV. The test sheet was then further treated electrochemically in a neutral salt electrolyte. This combined pickling process showed an advantage over conventional neutral electrolyte treatment in that approximately 20% more pickling loss can be achieved with slightly lower brightness at the same charge density of about 600 $A^*sec/dm^2$. For example, a large-scale plant containing six electrochemical pickling cells can be optimized to such an extent that the first two cells can be operated with acid spent electrolyte with precisely set redox potential and the following four cells can be run with neutral electrolyte. The resulting advantages are: higher pickling losses in the electrochemical pickling section, i.e., shorter post-treatment in the subsequent chemical mixed acid ($HF+NHO_3$) pickling section. The final product has the same brightness. The further advantage is that the entire neutral electrolyte solution containing chromate can be recycled to the acidified spent electrolyte bath, thus eliminating the costs for $Cr^{6+}$ reduction.

A further advantage of this optimization is that the sodium sulfate solution ($Na_2SO_4$) needed for pickling in the neutral pH range can be recovered by neutralizing the acid electrolyte solution containing $H_2SO_4$, $Na_2SO_4$, $Fe^{2+}$, $Fe^{3+}$, $Cr^{3+}$, $Ni^{2+}$, with sodium hydroxide (NaOH) or sodium carbonate ($Na_2CO_3$) and the metal oxides ($Fe(OH)_2$, $Fe(OH)_3$, $Cr(OH)_3$, $Ni(OH)_2$) can then be recovered by filtration.

While various embodiments have been presented to illustrate the invention, it will be understood by those skilled in the art that various modifications can be made without departing from the scope of the invention as defined in the appended claims.

What is claimed is:

1. A process of pickling a stainless steel metal substrate comprising the steps of:

combining a spent neutral salt electrolyte pickling solution obtained from a neutral salt electrochemical pickling process with an acid solution thereby forming an acid pickling solution, said acid pickling solution being substantially in the absence of nitric acid, and contacting a stainless steel metal substrate with said acid pickling solution for a time sufficient to pickle said stainless steel metal substrate.

2. The process of claim 1, wherein said stainless steel metal substrate is a cold-rolled stainless steel strip.

3. The process of claim 1, wherein said spent neutral salt electrolyte pickling solution is a spent sodium sulfate electrolyte solution from a cold-rolled stainless steel pickling process.

4. The process of claim 1, wherein said acid solution contains an acid selected from the group consisting of hydrofluoric acid, sulfuric acid, hydrochloric acid, and mixtures thereof.

5. The process of claim 1, wherein said acid pickling solution contains a mixture of a bivalent iron salt and a trivalent iron salt.

6. The process of claim 1, further comprising adding iron sulfate to said acid pickling solution.

7. The process of claim 1, comprising adding a corrosion inhibitor to said acid pickling solution.

8. The process of claim 1, further comprising the step of adding an oxidizing agent to said acid pickling solution.

9. The process of claim 1, further comprising the step of passing said stainless steel metal substrate through a neutral salt electrolyte solution and electrolytically pickling said stainless steel metal substrate to produce said spent neutral salt electrolyte pickling solution.

10. The process of claim 1, further comprising withdrawing an amount of said spent neutral salt electrolyte pickling solution from an electrolytic pickling bath and directing said spent neutral salt electrolyte pickling solution to said acid pickling solution.

11. The process of claim 1, where said pickling step produces a spent pickling acid containing substantially no $Cr^{6+}$.

12. The process of claim 1, comprising contacting said stainless steel metal substrate with said acid pickling solution for a time sufficient to produce $Fe^{2+}$ and $Cr^{6+}$, to oxidize said $Fe^{2+}$ to $Fe^{3+}$ and to reduce said $Cr^{6+}$ to $Cr^{3+}$.

13. The process of claim 3, comprising measuring a redox potential of said acid pickling solution and adding said spent neutral salt electrolyte pickling solution to said acid pickling solution in amounts to maintain a predetermined redox potential.

14. The process of claim 8, wherein said oxidizing agent is hydrogen peroxide.

15. The process of claim 9, comprising the step of feeding said spent neutral salt electrolyte pickling solution from said electrolytic process to said acid pickling solution.

16. The process of claim 12, wherein said acid pickling solution contains iron sulfate.

17. The process of claim 15, comprising:

withdrawing spent acid pickling solution from said acid pickling process step;

neutralizing said spent acid pickling solution to form insoluble metal hydroxides and to form a regenerated electrolyte solution;

separating said metal hydroxides from said regenerated electrolyte solution; and feeding said regenerated electrolyte solution to said acid pickling solution to replenish said acid pickling solution.

18. The process of claim 17, comprising neutralizing said spent acid pickling solution by adding a neutralizing agent selected from the group consisting of sodium hydroxide, sodium carbonate, and mixtures thereof.

* * * * *